US005307033A

United States Patent [19]

Koscica et al.

[11] Patent Number: 5,307,033

[45] Date of Patent: Apr. 26, 1994

[54] PLANAR DIGITAL FERROELECTRIC PHASE SHIFTER

[75] Inventors: Thomas E. Koscica, Clark; Richard W. Babbitt, Fair Haven; William C. Drach, Trenton, all of N.J.

[73] Assignee: The United States of America as represented by the Secretary of the Army, Washington, D.C.

[21] Appl. No.: 6,358

[22] Filed: Jan. 19, 1993

[51] Int. Cl.[5] ..... H01P 1/18; H01P 3/08

[52] U.S. Cl. ..... 333/161; 333/33

[58] Field of Search ..... 333/156–164, 333/33, 140, 246; 343/754, 909, 756; 342/375

[56] References Cited

U.S. PATENT DOCUMENTS 3,295,138 12/1966 Nelson ..... 333/164 X
3,568,105 3/1971 Felsenheld ..... 333/161
4,305,052 12/1981 Baril et al. ..... 333/161 X
5,032,805 7/1991 Elmer et al. ..... 333/156
5,212,463 5/1993 Babbitt et al. ..... 333/161

*Primary Examiner*—Seungsook Ham
*Attorney, Agent, or Firm*—Michael Zelenka; William H. Anderson

[57] ABSTRACT

A planar stripline type of ferroelectric phase shifter which includes a set of series coupled phase shifter sections, each having mutually different and binary weighted lengths of ferroelectric phase shifting material. Fixed amplitude control voltages are respectively applied to one or more lengths of ferroelectric material the permittivity and effective electrical length of which change to provide a desired composite phase shift. The phase shifter, moreover, employs half wavelength spacings between elements or matching networks therebetween so that the microwave signal propagating through the phase shift will be minimally impeded between the input end and an output end.

12 Claims, 1 Drawing Sheet

PLANAR DIGITAL FERROELECTRIC PHASE SHIFTER

GOVERNMENT INTEREST

The invention described herein may be manufactured, used and licensed by or for the Government for governmental purposes without the payment to us of any royalties thereon.

BACKGROUND OF THE INVENTION

1. Field of the Invention

This invention relates generally to microwave phase shifters of electromagnetic energy and more particularly to electrically controlled phase shifters of microwave and millimeter wave signals.

2. Description of the Prior Art

Microwave or millimeter wave phase shifters are generally known and typically comprise ferrite type phase shifters located in waveguide transmission line circuits. A phase shifter is generally characterized by a two port RF transmission line where the phase of the output signal is varied with respect to the input signal by changing the field in which the ferrite is immersed. Phase shifts up to 360° are obtainable in a relatively small structure.

More recently, an electrically controlled phase shifter has been developed which uses a transmission line fabricated from material which changes its permittivity by changing an applied DC electric field in which it is located. Such a device is shown and described, for example, in U.S. Pat. No. 5,032,805 issued to Frank J. Elmer et al on Jul. 16, 1991. The teachings of this patent are meant to be incorporated herein by reference. The device disclosed in the Elmer et al patent is constructed from a ceramic material, such as strontium-barium titanate, the permittivity of which changes with changes in applied electric field. The change in permittivity results in the change in the effective electrical length of the device, thus changing the delay or phase of an electromagnetic wave propagating through the device. Moreover, the device comprises an analog type of phase shifter requiring a voltage drive circuit having a variable voltage output to control the amount of phase shift provided.

SUMMARY OF THE INVENTION

It is an object of the present invention, therefore, to provide an improvement in electrically controlled phase shifters.

It is another object of the invention to provide a digital type of electrically controlled phase shifter.

It is yet a further object of the invention to provide a planar type of digital type ferroelectric phase shifter utilizing microstrip components.

It is still another object of the present invention to provide a digital type ferroelectric phase shifter which utilizes a less complex voltage drive circuit than conventional analog type phase shifters.

And it is still yet another object of the invention to provide a digital type ferroelectric phase shifter having a lower fabrication cost as well as smaller size and which can be integrated into the structure of microwave and millimeter wave integrated circuits.

The foregoing and other objects are achieved by a planar stripline type of ferroelectric phase shifter comprised of a set of series coupled phase shifter sections, each having mutually different lengths of ferroelectric material. Fixed amplitude permittivity changing control voltages are respectively applied to one or more lengths of ferroelectric material which incrementally provide a desired composite phase shift. The phase shifter, moreover, employs half wavelength spacings between elements or matching networks therebetween so that the microwave signal propagating through the phase shift will pass unimpeded through all of the phase shifter sections.

BRIEF DESCRIPTION OF THE DRAWINGS

The following detailed description of the invention will be more readily understood when considered in conjunction with the accompanying drawings wherein.

DETAILED DESCRIPTION OF THE INVENTION

Figure 1:
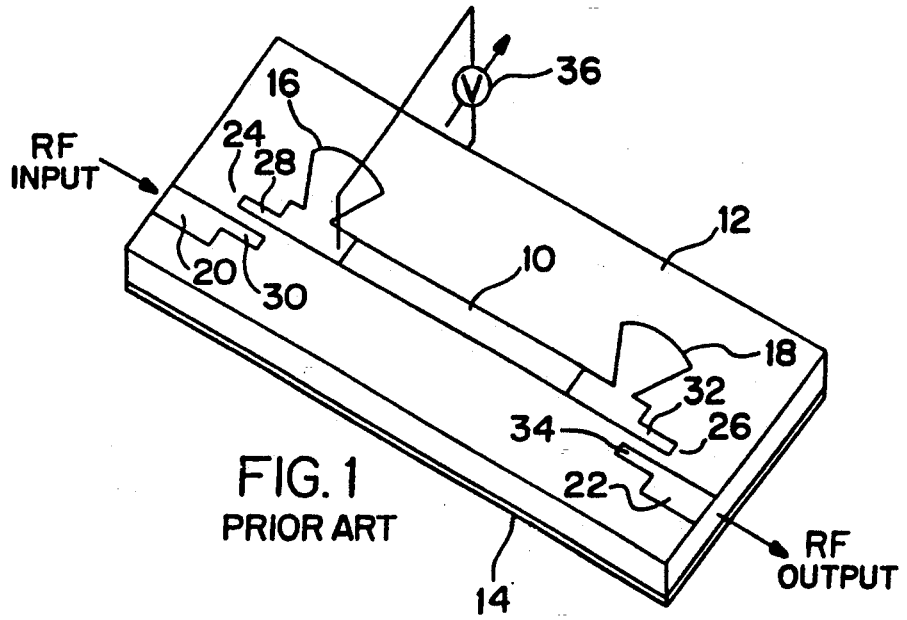
FIG. 1 PRIOR ART
FIG. 1 is a perspective view generally illustrative of a conventional analog type of ferroelectric phase shifter.

Referring now to the drawings wherein like reference numerals refer to like components throughout, FIG. 1 is illustrative of a conventional planar analog ferroelectric phase shifter in the form of a stripline device comprised of a length 10 of ferroelectric material, typically barium-strontium titanate ($Ba_xSr_{1-x}TiO_3$) fabricated on a ceramic substrate 12 and further including a metallic ground plane 14 on the bottom surface thereof. The ferroelectric element 10 is contiguous to radial open circuit shunt stub type impedance matching sections 16 and 18 which couple respectively to input and output microstrip elements 20 and 22. Between the impedance matching elements 16 and 18 and the microstrip elements 20 and 22, are a pair of DC voltage blocks 24 and 26 comprised of relatively narrow strips 28, 30 and 32, 34 which are mutually parallel and separated from each other a predetermined distance.

Further as shown, a variable voltage source 36 for applying an electric field to the ferroelectric element 10 is coupled between the microstrip transmission line including the ferroelectric element 10 and the ground plane 14.

In operation, depending upon the magnitude of the voltage set via the variable voltage source 36, the permittivity of the ferroelectric element 10 changes along with its effective electrical length, thus changing the delay or phase of a microwave or millimeter wave signal propagating through the device between its input end and its output end.

Figure 2:
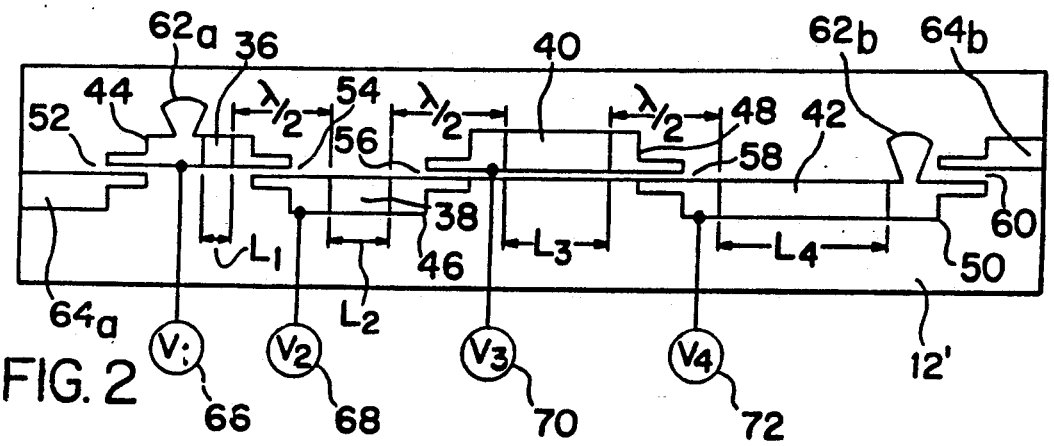
FIG. 2 is a top plan view illustrative of a first preferred embodiment of the subject invention.
Figure 3:
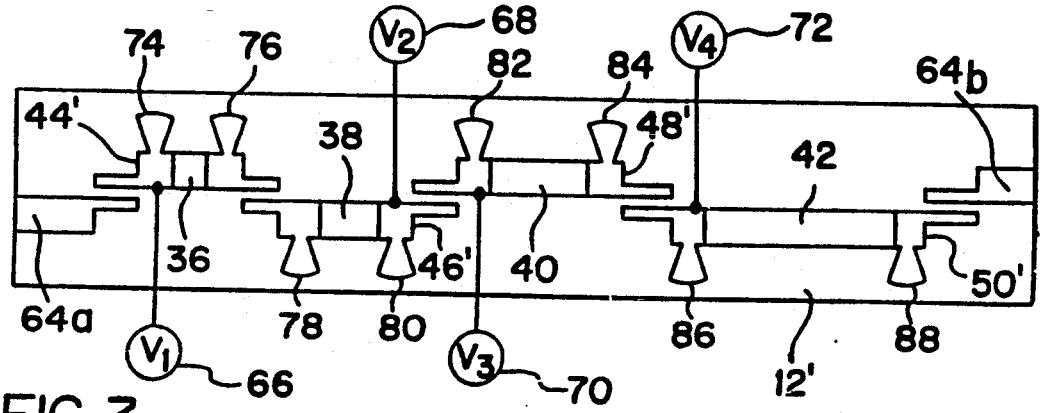
FIG. 3 is a top plan view illustrative of a second preferred embodiment of the invention.

Referring now to the preferred embodiments of the subject invention which are depicted in FIGS. 2 and 3, the configuration shown in FIG. 2 depicts a 4-bit digital phase shifter having four different and unequal lengths $L_1$, $L_2$, $L_3$ and $L_4$ of ferroelectric phase shifting elements 36, 38, 40 and 42 respectively fabricated in four stripline sections 44, 46, 48 and 50. Each of the sections are mutually separated by DC voltage blocks 52, 54, . . . 60, with the first and last DC blocks 52 and 60 terminating in input and output microstrip elements $64_a$ and $64_b$. The ferroelectric elements 36, 38, 40 and 42 are separated by half wavelength spacing and have lengths which are multiples of one another such that $L_4=2L_3=4L_2=8L_1$. The first and last phase shifter sections 44 and 50, moreover, include radial type open circuit shunt stub impedance matching elements $62_a$ and $62_b$. All of the stripline elements are fabricated on the surface of a ceramic substrate 12 having a metallic ground plane, not shown, on the bottom surface thereof as shown in FIG. 1.

Each of the phase shifting sections 44, 46, 48 and 50 are each coupled to separate fixed amplitude voltage sources 66, 68, 70 and 72, each source providing a set voltage $V_1$, $V_2$, $V_3$ and $V_4$, all of which are set to either zero voltage or a bias voltage $V_{bias}$. The embodiment of the phase shifter shown in FIG. 2 provides a 360° phase shift capability such that when ferroelectric element 36 of length $L_1$ is biased by the voltage source 66 ($V_1$), a 22.5° phase shift is provided, ferroelectric element 38 of length $L_2$ provides 45° of phase shift when biased by voltage source 68($V_2$), ferroelectric element 40 of length $L_3$ provides a phase shift of 90° when a bias voltage from voltage source 70($V_3$) is applied, and ferroelectric element 42 of length $L_4$ provides a phase shift of 180° when a bias voltage from voltage source 72($V_4$) is applied. Any combination of desired phase shift can be achieved by selectively switching on the proper voltage sources 66, 68,70 and 72 to ferroelectric elements 36, 38, 40 and 42, respectively, whose permittivity changes by a fixed amount in response to the applied voltages in a binary digital fashion. This phase shift, therefore, is a consequence of the binary weighted length.

The half wavelength spacings $\lambda/2$ between the ferroelectric elements 36, 38, 40 and 42 permit a microwave signal applied to input microstrip element 62 to propagate unimpeded through all of the elements to the output microstrip element 64. Such an arrangement, moreover, would be useful for applications of frequencies in the range of 10 GHz and above.

With an increase in the bandwidth of the phase shifter operation, the configuration shown in FIG. 3 could be utilized. This configuration is essentially identical to that shown in FIG. 2 except now that each of the phase shift sections 44', 46', 48' and 50' each include a pair of radial open circuit shunt stub type impedance matching elements 74, 76; 78, 80; 82, 84; and 86, 88 on opposite sides of the ferroelectric elements 36, 38, 40 and 42. With such an arrangement, the matching stubs at each ferroelectric element remove the half wavelength spacings (FIG. 2) constraint and thus improve the operating bandwidth.

The digital type ferroelectric phase shifter as shown in FIGS. 2 and 3 is particularly applicable for radars utilizing electronic scanning as well as other phase shifter applications. Because the voltage sources 66, 68, 70 and 72 provide only two distinct voltages (zero and $V_{bias}$) for the individual ferroelectric elements 36, 38, 40 and 42, a less complex voltage drive circuit is required in comparison to that of the variable voltage drive as required for prior art planar phase shifters such as that shown in FIG. 1. With this less complex voltage drive configuration, the innovative features of the subject invention lower the cost of fabrication and result in a relatively smaller size than current magnetic ferrite type phase shifters.

Having thus shown and described what is at present considered to be the preferred embodiments of the invention, it should be noted that the same has been made by way of illustration and not limitation. Accordingly, all modifications, alterations and changes coming within the spirit and scope of the invention as set forth in the appended claims are meant to be included.

We claim:

1. A digital phase shifter comprising:

a plurality of intercoupled planar type microwave and millimeter wave phase shifter sections fabricated on a substrate, each section including a phase shifter element having a predetermined length and whose permittivity and effective electrical length are a function of a respective electric field applied thereto;

means for applying separate electric fields of fixed magnitude in a binary digital operational mode to each of said phase shifter elements for providing a respective amount of fixed phase shift to microwave and millimeter wave signals propagating through said phase shifter sections;

first microwave and millimeter wave transmission line means for coupling said signals to a first phase shifter section of said plurality of phase shifter sections; and second microwave and millimeter wave transmission line means for coupling said signals from a last phase shifter section of said plurality of phase shifter sections.

2. The digital phase shifter of claim wherein said plurality of phase shifter sections are serially coupled.

3. The digital phase shifter of claim 2 wherein said phase shifter sections comprise stripline conductor sections.

4. The digital phase shifter of claim 3 wherein said phase elements comprise planar type elements of unequal lengths for providing different values of fixed phase shift.

5. The digital phase shifter of claim 4 wherein the lengths of said phase shifter elements are multiples of each other for digitally generating a predetermined range of composite phase shifts.

6. The digital phase shifter of claim 5 wherein said phase shifter elements are comprised of ferroelectric material.

7. The digital phase shifter of claim 6 and additionally including DC voltage block means between said first transmission line means, adjacent phase shifter sections, and said second transmission line means.

8. The digital phase shifter of claim 7 wherein said phase shifter elements are mutually spaced a half wavelength apart.

9. The digital phase shifter of claim 8 wherein said first and said last phase shifter sections additionally including impedance matching means for forming an impedance matched signal transmission path through said phase shifter sections.

10. The digital phase shifter of claim 9 wherein said impedance matching means comprises stripline types of radial open circuit shunt stubs.

11. The digital phase shifter of claim 7 wherein each of said phase shifter sections includes impedance matching means on both side of the respective phase shifter elements for forming an impedance matched signal transmission path through said phase shifter sections.

12. The digital phase shifter of claim 11 wherein said impedance matching means comprise stripline type open circuit shunt stubs.

* * * * *